US005346444A

United States Patent [19]

Hsieh

[11] Patent Number: 5,346,444

[45] Date of Patent: Sep. 13, 1994

[54] CONTROL VALVE FOR AN EXERCISE STAIR DEVICE

[76] Inventor: Kuo C. Hsieh, P.O. Box 82-144, Taipei, Taiwan

[21] Appl. No.: 45,050

[22] Filed: Apr. 8, 1993

[51] Int. Cl.[5] ..... A63B 21/008

[52] U.S. Cl. ..... 482/53; 482/112

[58] Field of Search ..... 482/52, 53, 111, 112, 482/113, 79, 80, 148

[56] References Cited

U.S. PATENT DOCUMENTS

| | | | |
|---|---|---|---|
| 4,204,675 | 5/1980 | McGinnis | 482/112 |
| 4,601,467 | 7/1986 | Gvoich et al. | 482/113 |
| 5,186,700 | 2/1993 | Wang | 482/111 |

FOREIGN PATENT DOCUMENTS

| | | | |
|---|---|---|---|
| 0073744 | 3/1983 | European Pat. Off. | 482/53 |

*Primary Examiner*—Stephen R. Crow
*Attorney, Agent, or Firm*—Alfred Lei

[57] ABSTRACT

This invention relates to a control valve for an exercise stair device comprising a cylinder having three nozzles, a spring disposed within the cylinder, a ferrule mounted on the spring, a valve plate fitted on the ferrule, a piston housing the spring, the ferrule and the valve and disposed within cylinder, a spring-loaded spline inserted into the piston and supported by the frame of the piston, and a lid engaged with the upper ends of the spring-loaded spline and the piston, whereby the exercise stair device may be easily adjusted to adapt to the needs of various users.

1 Claim, 6 Drawing Sheets

CONTROL VALVE FOR AN EXERCISE STAIR DEVICE

BACKGROUND OF THE INVENTION

While the type and extent of the exercise individuals practice often depends on a physician's recommendations, it is recognized that exercise should not only be regular but also sufficiently strenuous to cause the heart beat to be accelerated for a reasonable but substantial interval.

For many, exercise outdoors is preferred with jogging popular while others enjoy brisk walks. For others, however, weather conditions and the character of the neighborhood make necessary to use a captive bicycle or a treadmill exerciser.

Such devices, however, are monotonous to use as a consequence of which, interest in an exercise program is often lost so that what is needed is a way to make the use of such devices a pleasurable interval with the exercise automatically taking place.

Hence, an exercise stair device has been developed to meet this need. However, the operation of such devices is unsatisfactory in use.

It is, therefore, an object of the present invention to provide a control valve for an exercise stair device which may obviate and mitigate the drawbacks.

SUMMARY OF THE INVENTION

This invention relates to a control valve for an exercise stair device.

It is the primary object of the present invention to provide a control valve for an exercise stair device which may ease the adjustment of the air in the inflatable ball of the exercise stair device.

It is another object of the present invention to provide a control valve for an exercise stair device which may facilitate the charging and discharging of the inflatable ball.

It is still another object of the present invention to provide a control valve for an exercise stair device which will produce music with the rhythm of the exercise.

It is still another object of the present invention to provide a control valve for an exercise stair device which is simple in construction.

It is a further object of the present invention to provide a control valve for an exercise stair device which is economic to manufacture.

Other objects of the invention will in part be obvious and in part hereinafter pointed out.

DETAILED DESCRIPTION OF THE PREFERRED EMBODIMENT

Figure 1:
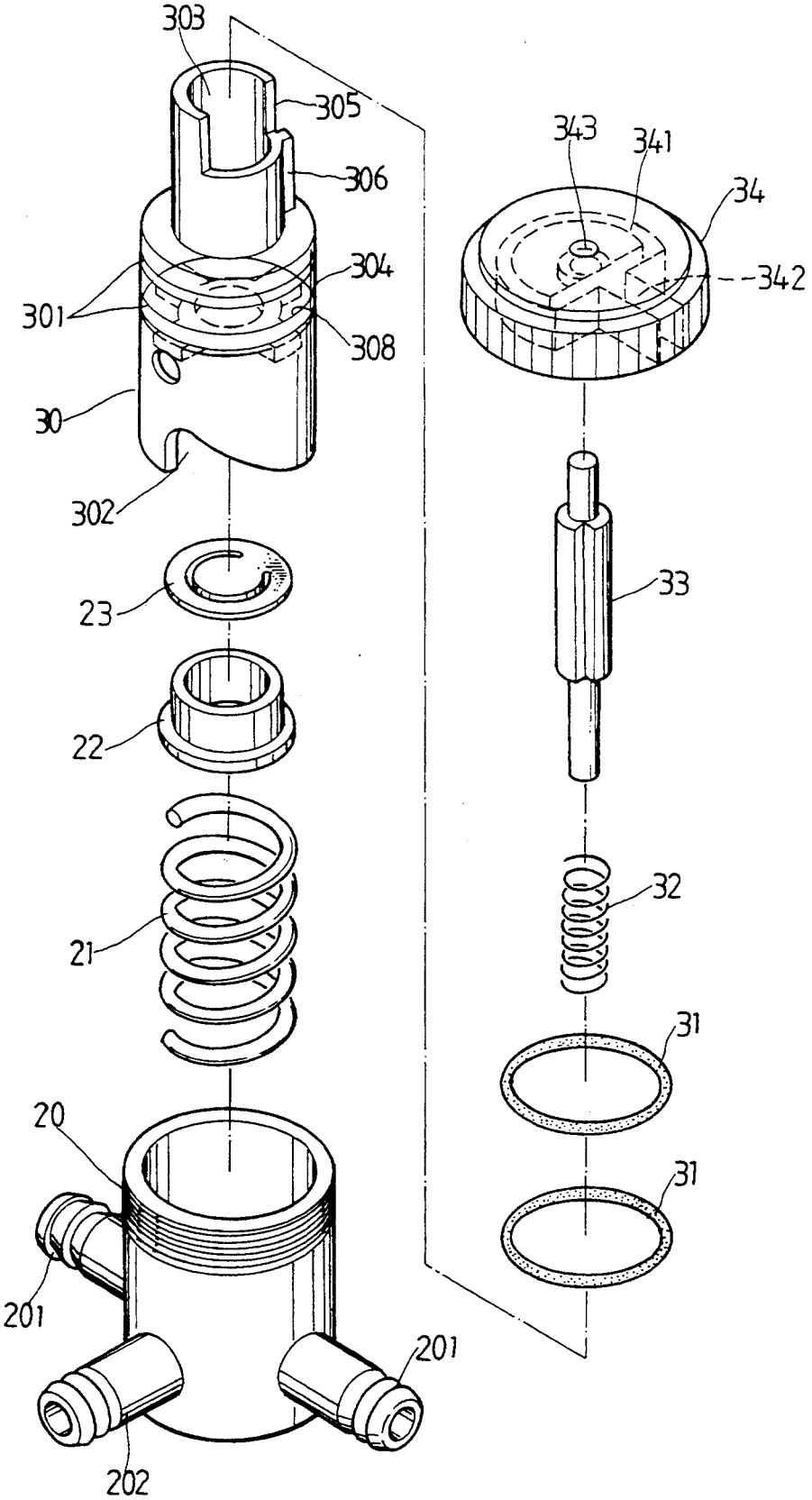
FIG. 1 is an exploded view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
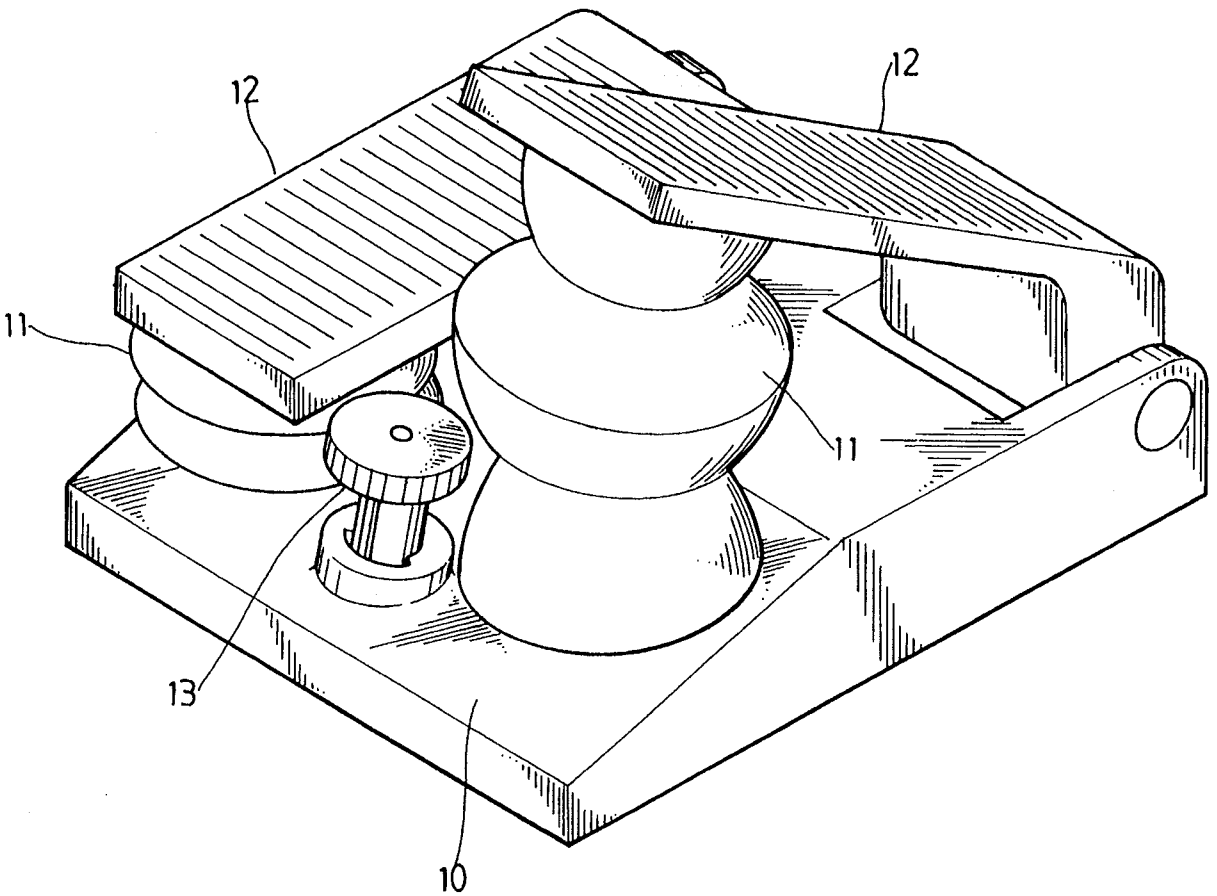
FIG. 2 is a perspective view showing an exercise stair device installed with the present invention.
Figure 3:
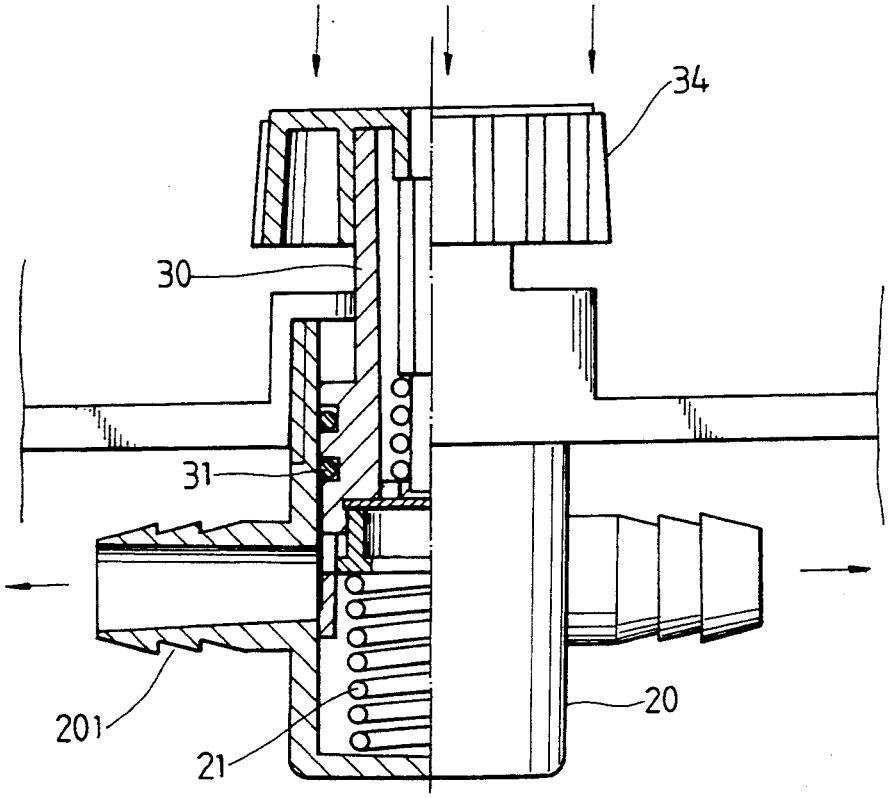
FIG. 3 shows the air charging state of the present invention.
Figure 4:
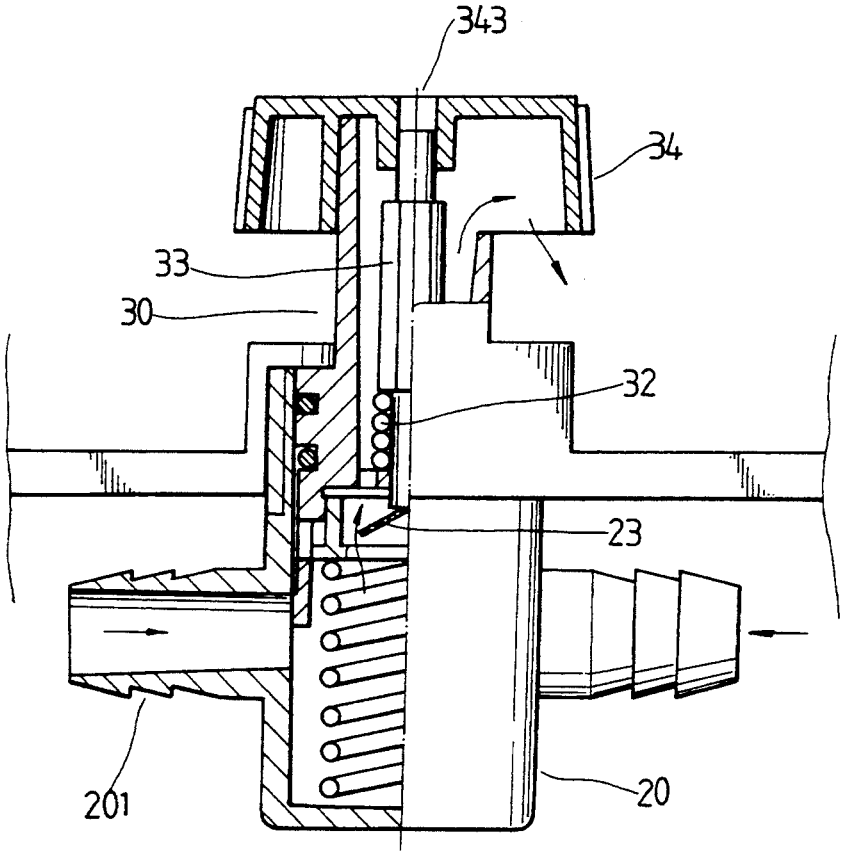
FIG. 4 shows the air discharging state of the present invention.
Figure 5B:
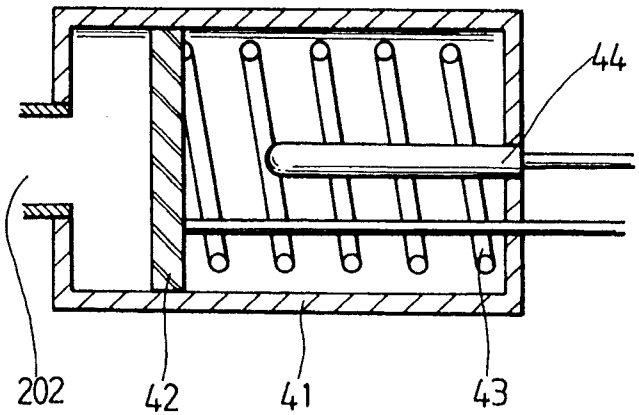
FIG. 5B is a sectional view of the sensor.
Figure 5A:
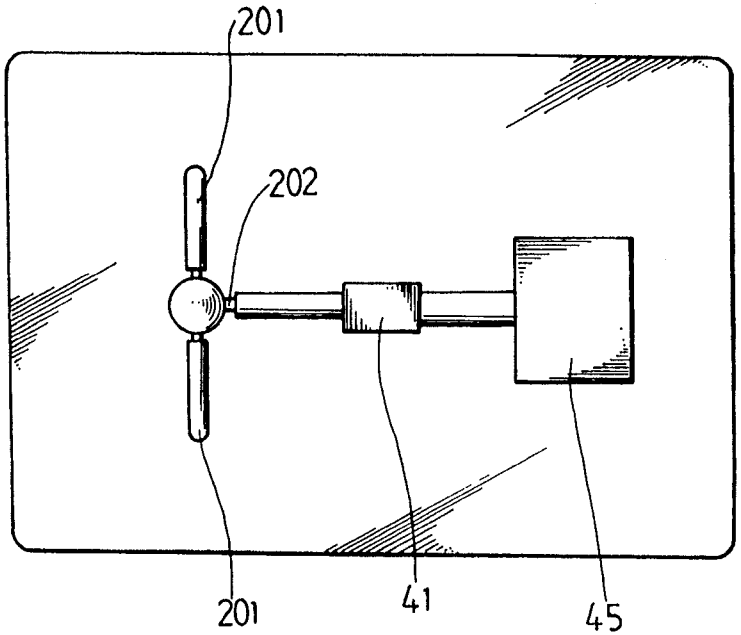
FIG. 5A shows the way to control the music producing device.
Figures 6A, 6B, 6C:
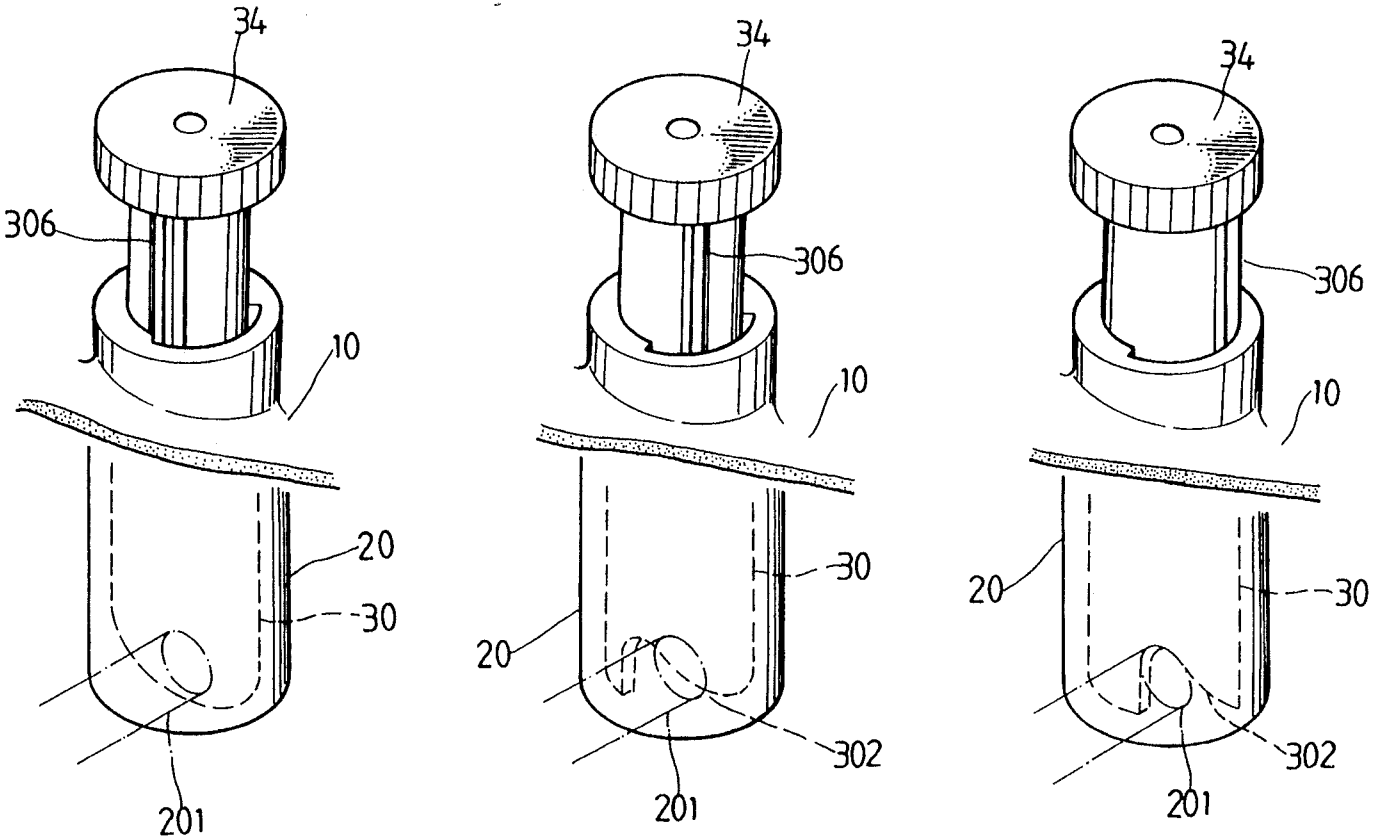
FIGS. 6A, 6B and 6C show the way to adjust the air pressure.

With reference to the drawings and in particular to FIGS. 1 and 2 thereof, the control valve 13 according to the present invention is mounted on a base 10 between two inflatable balls 11 and 111 of an exercise stair device.

As illustrated, the control valve 13 comprises a cylinder 20 provided with a first nozzle 201, a second nozzle 200 aligned with the first nozzle 201, and a third nozzle 202 perpendicular to a line extending through the first and second nozzles 201 and 200. A spring 21 is disposed within the cylinder 20. On the spring 21 there is a ferrule 22. A valve plate 23 is mounted on the ferrule 22. A rotatable piston 30 is just fitted into the cylinder 20 and provided with a plurality of grooves 301 each engaged with a seal ring 31. Further, the bottom of the piston 30 is formed with two opposite recesses 302 and 309. In addition, the piston 30 has a center hole 303 and a frame 304 with a plurality of slots 308. A spline 33 is inserted into the piston 30 and has its lower end enclosed by a spring 32. Besides, the upper end of the piston 30 has a recess 305 and a protuberance 304.

When in assembly, the piston 30 is first inserted into the cylinder 20 and then covered with a lid 34. The lid 34 is formed with a recess 341 having a notch 342.

In operation (see FIGS. 3, 6A, 6B and 6C), first turn the lid 34 to align the recess 302 with the nozzle 201 which is in communication with the inflatable ball 11. Then, press the lid 34 so as to cause air to go into the piston 30 through the notch 342. As the lid 34 is released, the spring 21 will return the lid 34 to its original position.

When desired to reduce the pressure in the inflatable balls 11 and 111, simply turn the lid 34 to align the recess 309 with the nozzle 200 and then use a pin (not shown) to press down the spline 33 through the hole 343 of the lid 34 thereby pushing open the valve plate 23 and therefore providing an open passage. Hence, the air in the inflatable ball 11 will be released to the atmosphere through the nozzle 200, the piston 30, the valve plate 23, and the notch 342. Once the pressure applied on the spline 33 is released, the spring 32 will rapidly push the the spline 33 back to its original position. Further, when desired to adjust the riding pressure, it is only necessary to turn the lid 34 so as to regulate the nozzle 201.

Further, the cylinder 20 is connected with an outlet 202 which is in communication with a sensor 41. Within the sensor 41 there are a spring 43, a conductive member 42 connected to a power supply (not shown), and a pin 44. The pin 44 is connected to a music producing device 45 so that when the pedal 12 is stepped on an inflatable ball 11, the air in the inflatable ball 11 will be forced to go into the other inflatable ball 111. In the meantime, the air will pass into the sensor 41 through the cylinder 20 to push the conductive member 42 to contact the pin 44 thereby turning on the music producing device 45 to produce music. However, when the pedal 12 is stepped to its lowest position, no air will flow into the sensor 41 and no pressure will apply to the conductive member 42. Then, the spring 43 will push the conductive member 42 away from the pin 44 thus turning off the music producing device 45.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An exercise stair device comprising: a frame, a pair of foot pedals pivotally connected at one end to said frame, pneumatic resistance means mounted adjacent the other ends of said foot pedals adapted to resistively engage said foot pedals, a control valve comprising:

a cylinder provided with a first nozzle, a second nozzle aligned with said first nozzle, and a third nozzle perpendicular to a line extending through said first nozzle and said second nozzle, said first nozzle being connected with a sensor which is in turn connected with a music producing device;

a spring disposed within said cylinder;

a ferrule mounted on said spring;

a valve plate fitted on said ferrule;

a piston housing said spring, said ferrule and said valve plate being disposed within said cylinder, said piston having a frame in an interior and being formed with recesses which will be aligned with said nozzles by turning said piston;

a spring-loaded spline inserted into said piston and supported by the frame of said piston; and a lid engaged with the upper ends of said spring-loaded spline and said piston, whereby the exercise stair device resistance is easily adjusted.

* * * * *